US010952513B2

(12) United States Patent
Ghirelli

(10) Patent No.: US 10,952,513 B2
(45) Date of Patent: Mar. 23, 2021

(54) ROSARY SUITED TO BE TRANSFORMED INTO A BRACELET

(71) Applicant: Ghirelli S.R.L., Occhiobello (IT)

(72) Inventor: Alessandro Ghirelli, S. Maria Maddalena (IT)

(73) Assignee: Ghirelli S.R.L., Occhiobello (IT)

( * ) Notice: Subject to any disclaimer, the term of this patent is extended or adjusted under 35 U.S.C. 154(b) by 73 days.

(21) Appl. No.: 16/436,560

(22) Filed: Jun. 10, 2019

(65) Prior Publication Data

US 2020/0281333 A1 Sep. 10, 2020

(30) Foreign Application Priority Data

Mar. 5, 2019 (IT) ..... 102019000003183

(51) Int. Cl.

| | |
|---|---|
| ***A44C 5/18*** | (2006.01) |
| ***A44C 5/20*** | (2006.01) |
| ***A44C 5/22*** | (2006.01) |
| ***A44C 5/24*** | (2006.01) |
| ***A44C 23/00*** | (2006.01) |

(52) U.S. Cl.
CPC ..... *A44C 23/00* (2013.01); *A44C 5/18* (2013.01)

(58) Field of Classification Search
CPC ..... A44C 23/00; A44C 5/18; A44C 15/001; A44C 15/005; A44C 25/005; A44C 5/00; A44C 25/001; A44C 25/00; A44C 25/004; Y10T 24/3904
USPC ..... 63/21, 23, 41, 3, 3.1, 18, 19
See application file for complete search history.

(56) References Cited

U.S. PATENT DOCUMENTS

| | | | | |
|---|---|---|---|---|
| 1,525,005 A * | 2/1925 | Sherman | A44C 5/00 | 63/3.1 |
| 1,704,919 A * | 3/1929 | Murray | A44C 23/00 | 63/3.2 |
| 2,637,438 A * | 5/1953 | Menz | A44C 23/00 | 206/19 |
| 4,530,221 A * | 7/1985 | Weinberg | A44C 5/209 | 24/116 A |

* cited by examiner

*Primary Examiner* — Jack W Lavinder
(74) *Attorney, Agent, or Firm* — Workman Nydegger

(57) ABSTRACT

A rosary includes a first section of a chain closed as a ring with five groups of beads divided in decades sliding freely thereon, the five groups of beads being spaced by a single bead that separates each group from the others; a second chain section connected to the first chain section and terminating with a crucifix, wherein the crucifix is divided in two parts and wherein, in proximity to each one of the two parts of the crucifix, there is at least one recess suited to house a part of the first ring-shaped chain section, so that when the two parts of the crucifix are joined in order to accommodate the part of the first ring-shaped chain section therein, the rosary assumes the shape of a bracelet.

14 Claims, 7 Drawing Sheets

ROSARY SUITED TO BE TRANSFORMED INTO A BRACELET

CROSS-REFERENCE TO RELATED APPLICATIONS

This application claims priority to Italian Application No. 102019000003183, filed Mar. 5, 2019, which is incorporated herewith.

BACKGROUND OF THE INVENTION

1. The Field of the Invention

The present invention concerns a rosary crown that can be transformed into a bracelet suited to be worn on the wrist by either a man or a woman.

2. The Relevant Technology

As is known, in fact, rosary crowns are used by Catholics all over the world for praying, and essentially consist of a so-called crown made up of a section of a chain closed as a ring, in which there are five groups of beads, each made up of ten decades and spaced from the others by a single bead.

The five groups of beads represent the Mysteries of the Rosary and each Mystery is recited with ten Hail Marys, while each Mystery is spaced from the others by a single bead for the recitation of one Glory Be.

The rosary as just described above comprises, in addition to the closed chain section, also a second linear chain section that is generally but not necessarily connected to said first section by means of a connection element and ends with a crucifix that can obviously have various shapes.

The connection element generally serves to connect the first chain section and is positioned immediately before the second linear chain section that ends with the crucifix.

It is also known that the use of very precious rosaries as necklaces is rather widespread, especially among women.

It cannot be excluded that the rosary used as an ornament can also be used for its primary purpose by the person who wears it, that is, for reciting the Rosary.

It is the object of the present invention to provide a special rosary that can be comfortably and simply transformed into a bracelet suited to be worn on a person's wrist, but, in any case, suited to be used for its primary function, that is, for praying.

According to the main characteristics of the invention, the beads of the rosary that are contained in the closed section of the chain are not fixed, but they can move along the chain that supports them, and this causes the desired effect which will be described below and which is the necessary feature for the transformation of the rosary into a bracelet.

A further characteristic is represented by the fact that the crucifix of said crown is made in such a way that it consists of two parts, in which there is at least one recess suited to house a part of the first ring-shaped chain section so that the rosary can assume the shape of a bracelet.

The invention is described in accordance with the contents of the first claim.

BRIEF DESCRIPTION OF THE DRAWINGS

Some embodiments of the invention are also described by way of non-limiting example and illustrated in the following drawings, wherein.

DETAILED DESCRIPTION OF THE PREFERRED EMBODIMENTS

Figures 1, 1A:
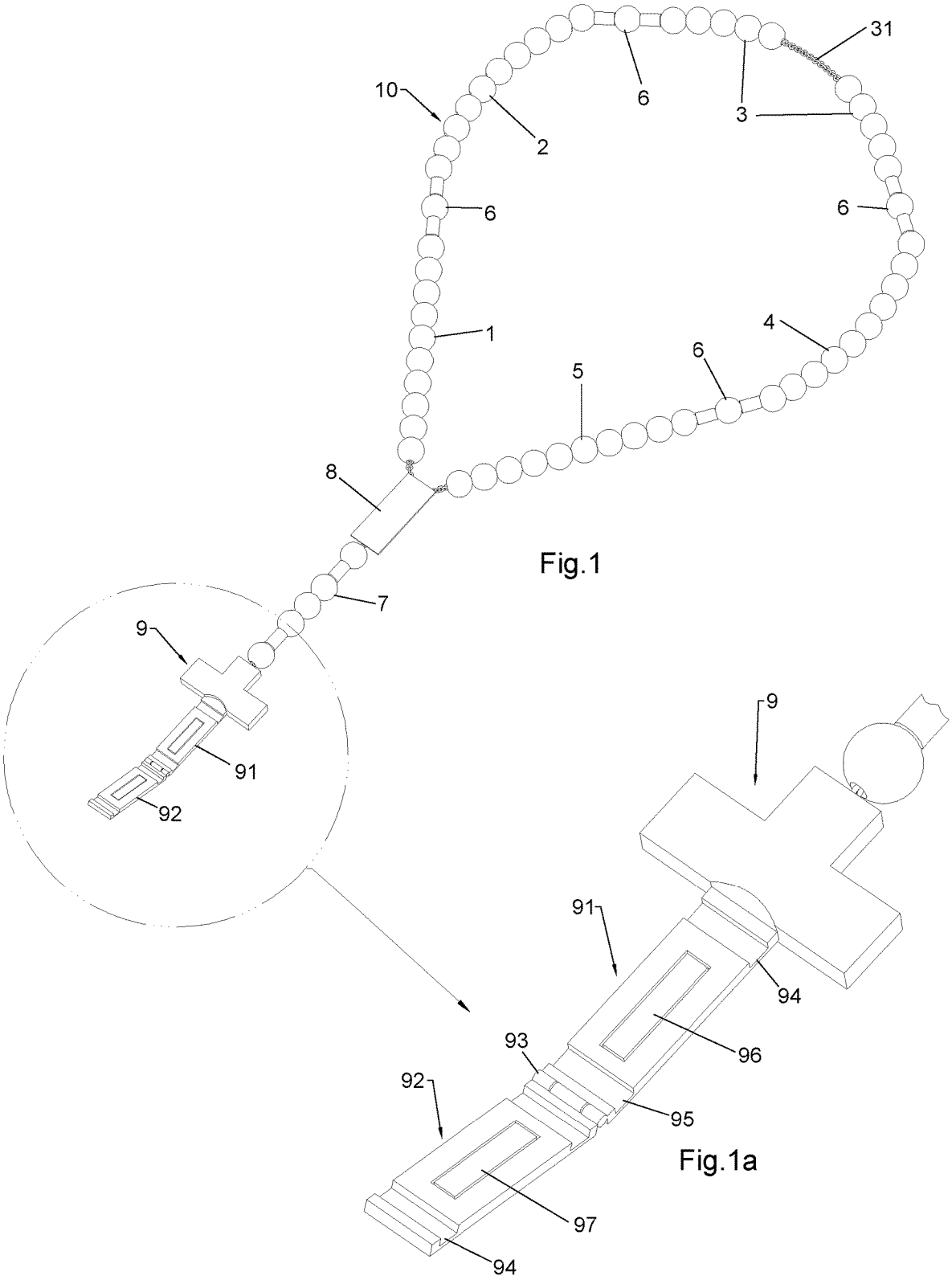
FIG. 1 shows a rosary suited to be transformed into a bracelet.
FIG. 1*a* shows a detail of FIG. 1 representing housings suited to accommodate a part of the ring-shaped chain.

With particular reference to FIG. 1, the rosary crown represented therein is formed by a first closed chain section indicated as a whole by 10, in which it is possible to identify five groups of beads 1, 2, 3, 4 and 5, each separated from the others by means of a single bead indicated by 6.

In addition to said first ring-shaped chain section, the rosary comprises a second linear section 7 connected to the first ring-shaped section 10 by means of a so-called connection element 8 on which it is possible to apply an image of the Virgin Mary, of a Saint or a specific wording.

The second linear section 7 is connected to a crucifix 9 that is substantially divided in two parts 91 and 92, as can be observed in FIG. 1.

Obviously, in a different embodiment, the part 92 that in the drawings of FIGS. 1 and 1*a* terminates under the crosspiece of the crucifix 9 may be such as to include also the upper part of the crucifix.

The parts 91 and 92 of the crucifix 9 are articulated with respect to each other by means of a hinge 93 that allows the part 92 to be opened with respect to the part 91 or to be superimposed to the latter.

Both parts 91 and 92 of said crucifix are provided with two recesses, a recess 94 in proximity to the crosspiece of the crucifix and the other recess 95 in proximity to the terminal portion of the final part of the crucifix itself.

Figures 2, 2A:
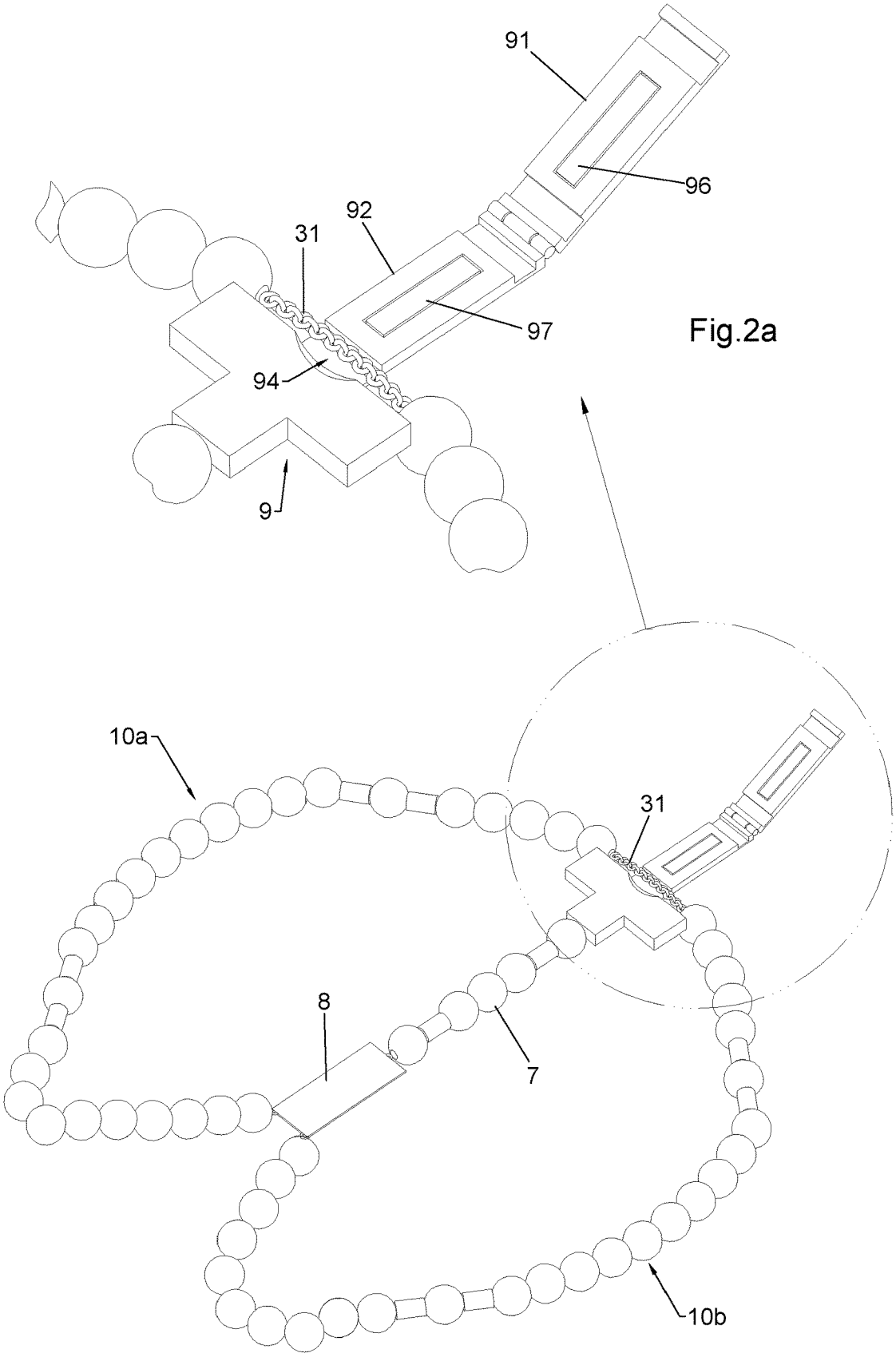
FIG. 2 shows how a part of the first ring-shaped chain section can be arranged in a housing provided in the crucifix of the rosary.
FIG. 2*a* shows a detail of FIG. 2.

Once the two parts 91 and 92 are closed, said recesses are suited to contain the chain section 31 that has been intentionally selected in the middle part of the first closed chain section, in such a way as to form two arms 10*a* and 10*b* equal to each other when, as shown in FIG. 2, the chain section 31 is placed in the recess 94.

It can be observed that the crucifix 9 is provided with connection means that make the two parts of the crucifix integral with each other, in such a way as to avoid the accidental opening of the crucifix when the chain section 31 has already been inserted therein.

These connection means can be a snap-on closure of the hinge 93 of known type or similar means.

It should also be noted that the presence of two recesses in the crucifix, as shown in FIGS. 1 and 2, is not necessary, since a single recess, either the recess 94 or the recess 95, may be enough, however two recesses have been provided for the purpose of adjusting the diameter of the bracelet according to the size of the arm of the person who is going to wear it.

Figure 3A:
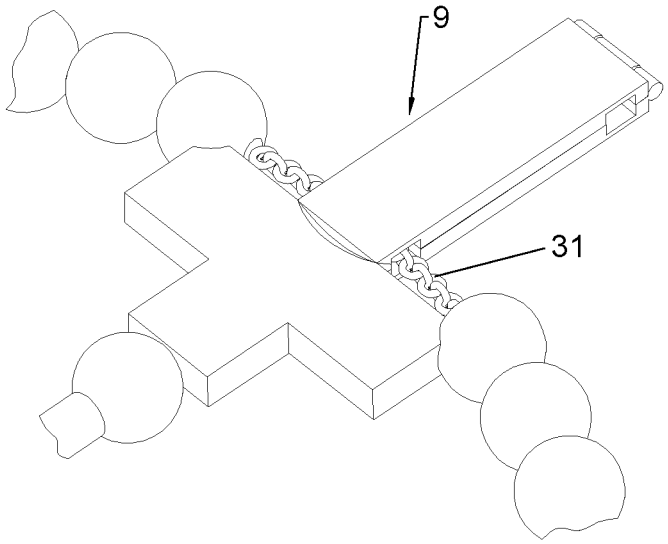
FIG. 3*a* shows an enlarged view of a detail of FIG. 3.
Figure 3:
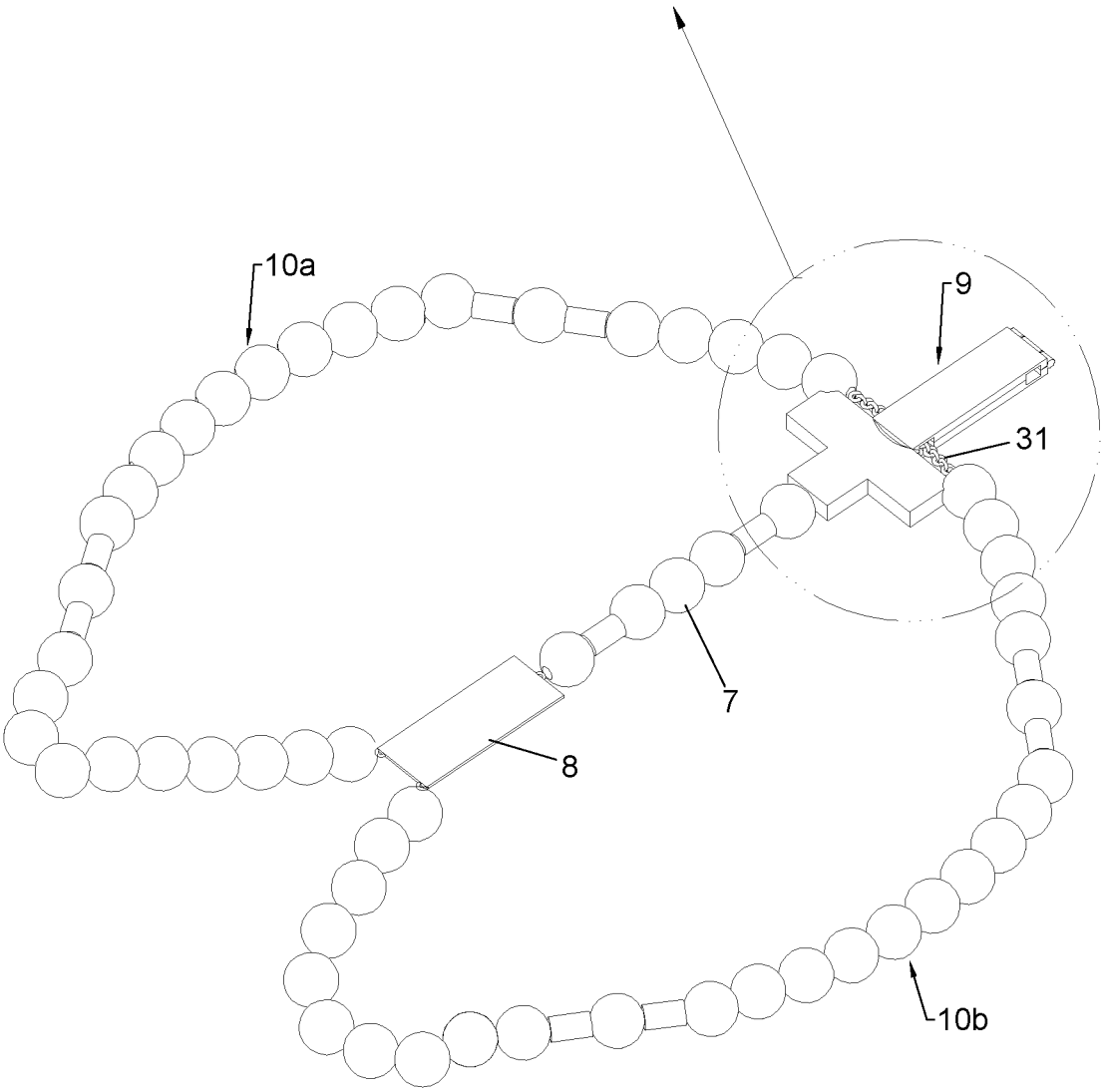
FIG. 3 shows how a part of the first chain section closed as a ring is inserted inside a crucifix.

According to the example of embodiment shown in FIGS. 1 and 2, the crucifix 9 is also provided with two magnetic plates 96 and 97 that, once the hinge 93 has closed the two parts of the crucifix together, ensure that, as shown in FIGS. 3 and 3*a*, the chain section 31 is held inside the recess 94 or 95 and thus maintained in the closed configuration.

Figure 4A:
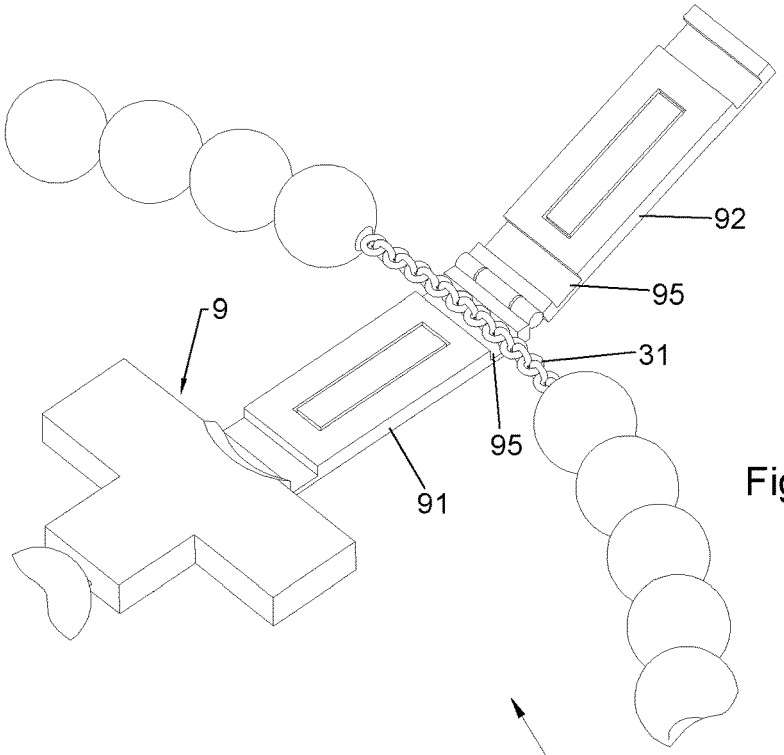
FIG. 4*a* shows an enlarged view of a detail of FIG. 4.
Figure 4:
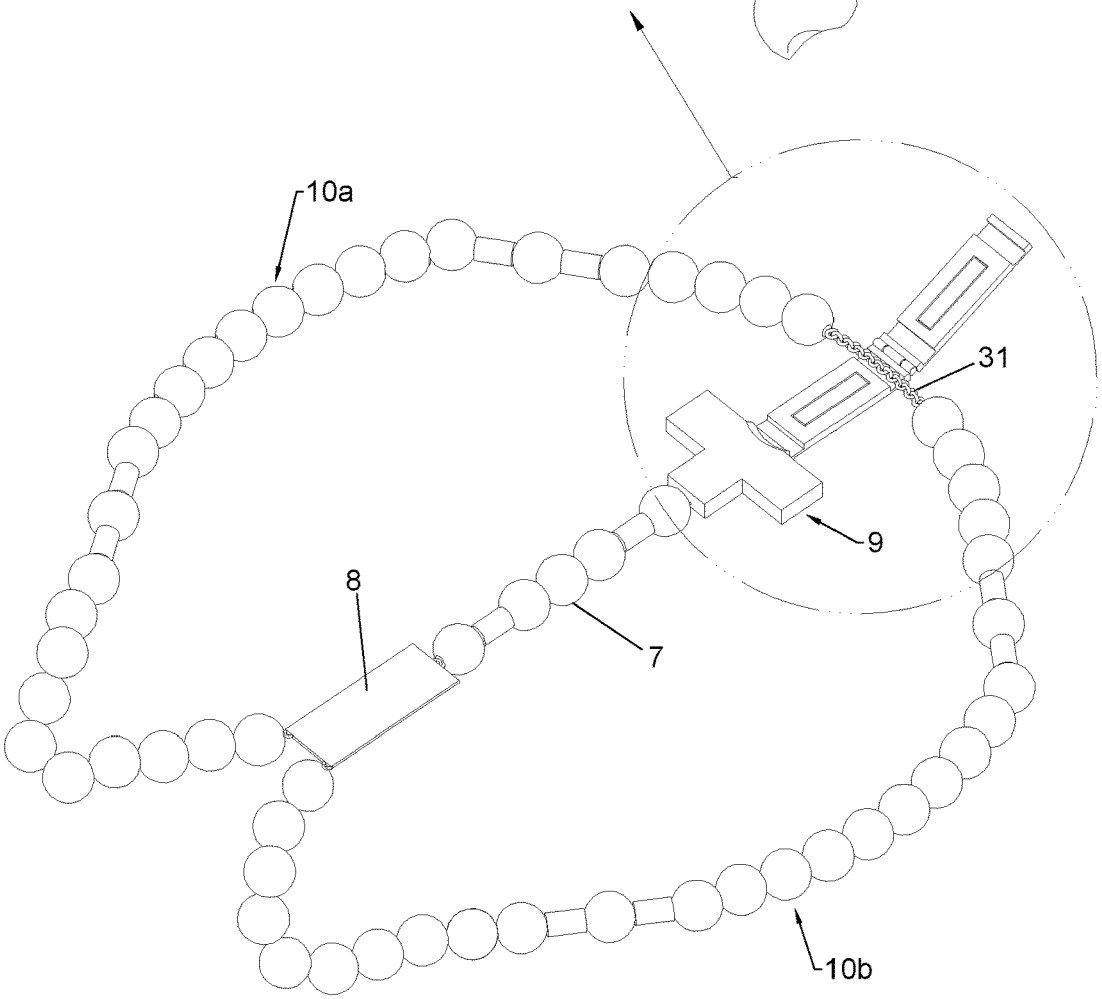
FIG. 4 shows a different arrangement of the first ring-shaped chain section that is placed in the recess provided in the lower portion of the crucifix instead of in the recess provided in the upper portion.

FIGS. 4 and 4*a* show that the chain section 31 belonging to the first closed chain section is arranged in the recess 95 instead of in the recess 94 in order to make the bracelet that is going to be created larger according to the size of the wrist that will wear it.

Figure 5A:
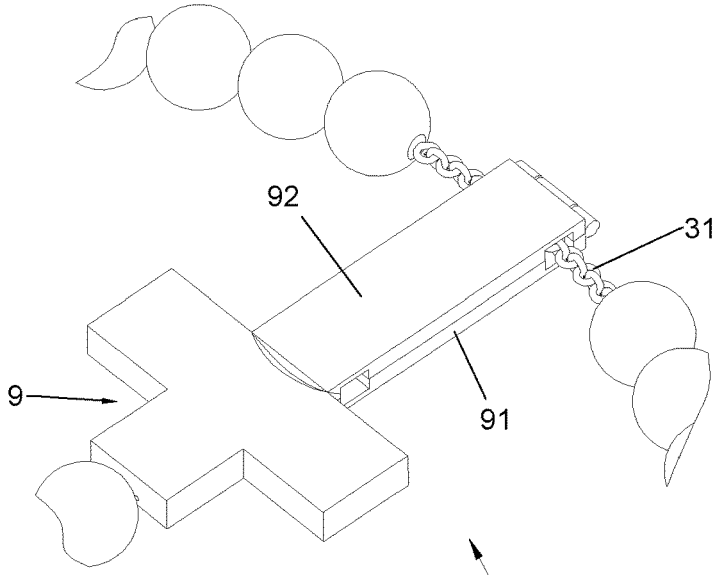
FIG. 5*a* shows the detail of FIG. 5 related to the crucifix.
Figure 5:
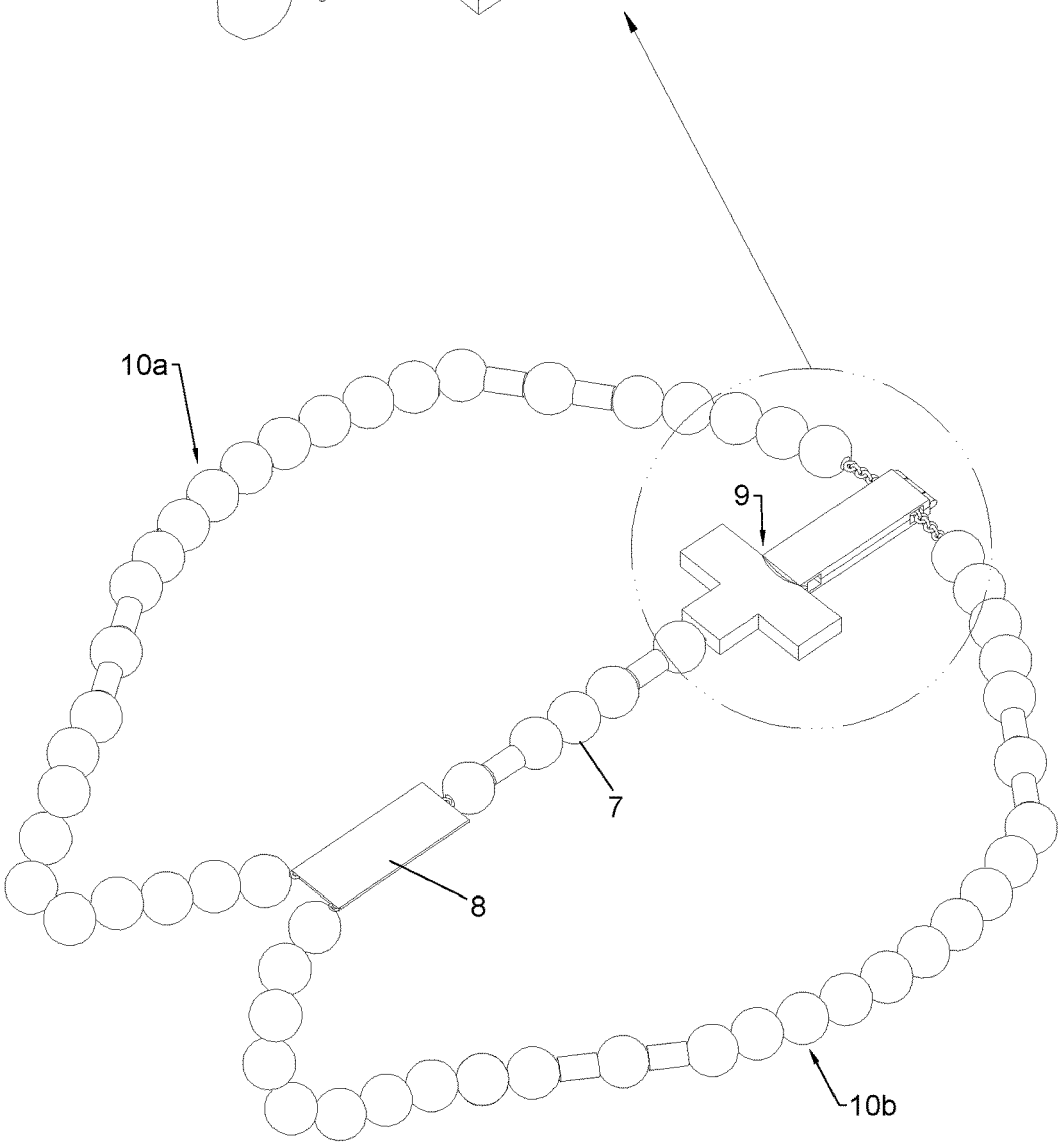
FIG. 5 shows the crucifix in the closed configuration with respect to FIG. 4.

FIGS. 5 and 5*a* show the closed configuration of the two parts of the crucifix 91 and 92, which has the purpose of securing the chain section 31 included in the recess 95 and of obtaining two sections 10*a* and 10*b* having the same length.

Figure 6:
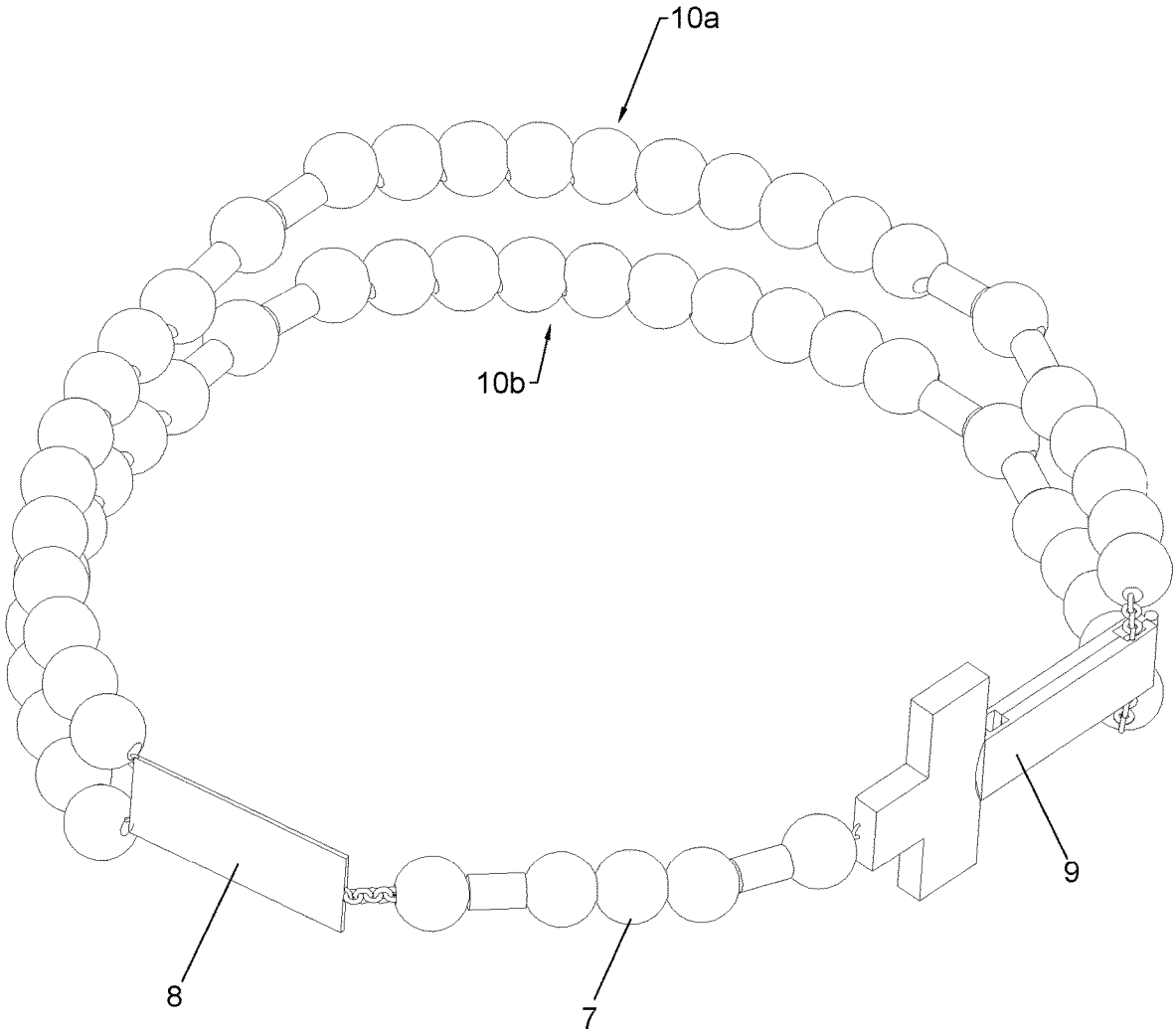
FIG. 6 shows the crown when transformed into a bracelet.

FIG. 6 shows the rosary of FIG. 5 when already transformed in a bracelet with a corresponding shape.

Figure 7:
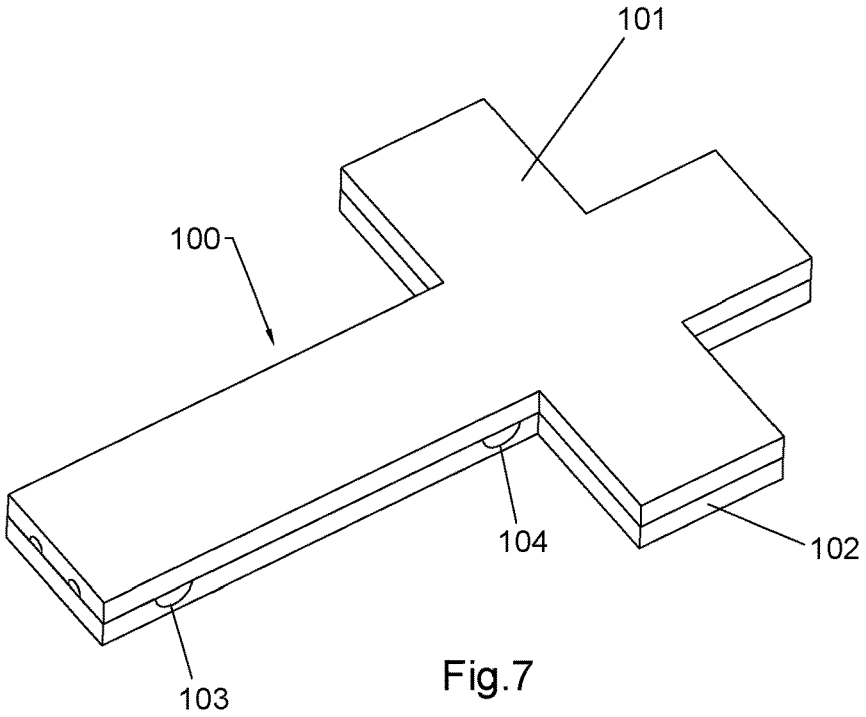
FIG. 7 shows a variant embodiment of the crucifix, equally suitable for the transformation of the rosary into a bracelet.
Figure 8:
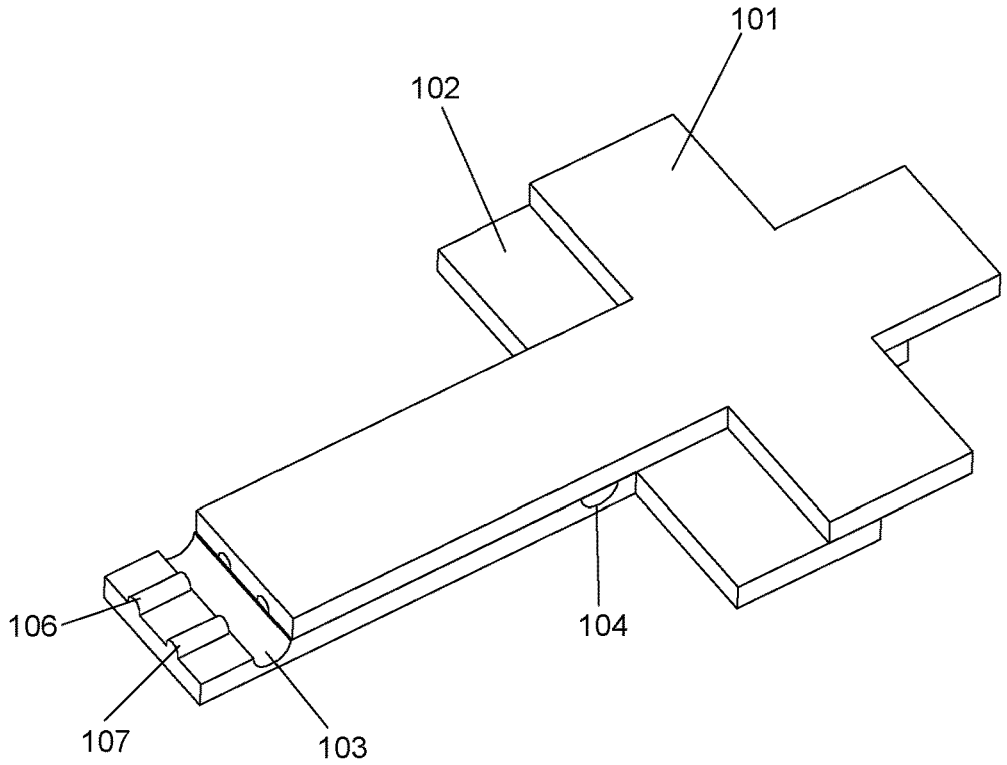
FIG. 8 shows a variant embodiment of the FIG. 1*a*.

FIGS. 7 and 8 show a different execution of the crucifix, suited to hold a part of the first closed chain section, indicated by 31 in the previous drawings, which is alternatively housed in grooves 103 or 104 belonging to a half of the crucifix, in this case to the half 102, rather than to the other half 101.

The two halves of the crucifix 101 and 102 slide on each other through guides 106 and 107, in such a way that the two parts 101 and 102 remain parallel to and aligned with each other.

According to the invention, in order to maintain the two halves 101 and 102 of the crucifix 100 joined to each other after the insertion of the chain section 31 in a groove, also said two halves 101 and 102 of the crucifix 100 are provided with at least one magnetic foil.

The two grooves 103 and 104 can be alternatively occupied by the chain section 31, in such a way as to obtain the configuration of a bracelet-shaped rosary.

As can be observed in the description, all the objects of the invention have been achieved, that is, the straightforward transformation of a rosary crown into a bracelet that can be simply and easily worn thanks to a specific configuration of the crucifix, which is suited to house a part of the chain on which the rosary beads slide.

Other configurations of the crucifix and of the recesses provided therein to house the chain section 31 are considered included in the present invention.

The invention claimed is:

1. A rosary comprising:

a first chain section forming a first closed loop having a first maximum diameter, five groups of beads divided in decades slide freely on the first chain section and are spaced out by a single bead that separates each group from the others;

a second chain section having a first end and an opposing second end, the first end of the second chain section being connected to the first chain section;

a cross secured to the second end of the second chain section, the cross comprising a first part and a second part, the second part being movable relative to the first part between a first position wherein a first recess formed on the first part or the second part is openly exposed and a second position wherein the second part overlays at least a portion of the first part so that the first recess is bound between the first part and the second part, wherein the first recess is configured to house a portion of the first chain section so that the first chain section, the second chain section, and the cross combine to form a second closed loop having a second maximum diameter that is smaller than the first maximum diameter.

2. The rosary according to claim 1, further comprising a second recess formed on the first part or the second part and spaced away from the first recess, the second recess being configured to house the portion of the first chain section so that the first chain section, the second chain section, and the cross combine to form a third closed loop having a third maximum diameter that is different than the second maximum diameter.

3. The rosary according to claim 1, wherein the portion of the first chain section is centrally located in a middle group of the five groups of beads.

4. The rosary according to claim 1, further comprising:

the first part and the second part of the cross being coupled together by a hinge located a bottom of the cross; and connection means for preventing accidental movement of the second part from the second position to the first position.

5. The rosary according to claim 4, wherein the connection means comprises at least one magnet securing the first part to the second part.

6. The rosary according to claim 1, wherein the first part and the second part of the cross are substantially symmetrical, the first part having at least one rectilinear guide that outwardly projects and is parallel to a main axis of the cross, the second part having a groove in which the at least one rectilinear guide is received when the second part is in the second position.

7. The rosary according to claim 6, further comprising at least one magnetic element that secures the second part to the first part when the second part is in the second position.

8. A rosary comprising:

a first chain section having a plurality of beads disposed thereon, the first chain section being closed as a ring;

a second chain section having a first end and an opposing second end, the first end of the second chain section being connected to the first chain section;

a cross secured to the second end of the second chain section, the cross comprising a first part and a second part, the second part being movable relative to the first part between a first position wherein a first recess formed on the first part or the second part is openly exposed and a second position wherein the second part overlays at least a portion of the first part so that the first recess is bound between the first part and the second part, wherein the cross is configured so that the first chain section can be selectively moved between:

a first arrangement wherein the first chain section is disposed outside of the first recess so that the first chain section independent of the second chain section forms a first closed loop having a first maximum diameter, and a second arrangement wherein a portion of the first chain section is captured within the first recess between the first part and the second part of the cross so that the first chain section, the second chain section, and the cross combine to form a second closed loop having a second maximum diameter that is smaller than the first maximum diameter.

9. The rosary according to claim 8, wherein the first chain section comprises a connection element, the first end of the second chain section being connected to connection element.

10. The rosary according to claim 8, wherein the second part of the cross is hingedly connected to the first part of the cross.

11. The rosary according to claim 8, wherein the second part of the cross is slidably connected to the first part of the cross.

12. The rosary according to claim 8, wherein the second part of the cross is magnetically coupled to the first part of the cross when the second part is in the second position.

13. The rosary according to claim 8, further comprising a second recess formed on the first part, the second recess being openly exposed when the second part is in the first position and being bound between the first part and the second part when the second part is in the second position, the second recess being spaced apart from the first recess and being configured to receive the portion of the first chain section.

14. The rosary according to claim 8, wherein the second recess is configured to house the portion of the first chain section so that the first chain section, the second chain section, and the cross combine to form a third closed loop having a third maximum diameter that is different than the second maximum diameter.

* * * * *